US005819971A

United States Patent [19]

Tseng

[11] Patent Number: 5,819,971

[45] Date of Patent: Oct. 13, 1998

[54] STORAGE BOX

[76] Inventor: Sen Piao Tseng, P.O. Box 82-144, Taipei, Taiwan

[21] Appl. No.: 986,855

[22] Filed: Dec. 8, 1997

[51] Int. Cl.[6] ..... B65D 43/14

[52] U.S. Cl. ..... 220/4.23; 220/337

[58] Field of Search ..... 220/4.23, 337, 220/338, 340, 342

[56] References Cited

U.S. PATENT DOCUMENTS

| | | | |
|---|---|---|---|
| 4,101,023 | 7/1978 | Schuander | 220/4.23 |
| 4,109,821 | 8/1978 | Lutz | 220/337 |
| 4,282,983 | 8/1981 | Swartzbaugh | 220/337 |
| 4,452,373 | 6/1984 | Pearce et al. | 220/337 |
| 5,125,523 | 6/1992 | Kulper | 220/4.23 |

*Primary Examiner*—Joseph M. Moy

*Attorney, Agent, or Firm*—A & J

[57] ABSTRACT

A storage box includes a bottom casing, a top cover, two hinge coupling plates, and a button seat. Both the bottom casing and the top cover have an interior defining a chamber. The rear sides thereof are respectively provided with hinge coupling seats each of which is provided with fastening holes for engaging corresponding bulges on the leaves of the hinge coupling plates to allow opening or closing of the box. The front side of the bottom casing is provided with a fastener coupling seat for receiving the button seat. The front side of the top cover is provided with a fastening groove for engaging a projecting hook of the button seat. The hinge coupling plates are configured to be multi-piece coupling elements with contacts at the middle section thereof to ensure that the contacts will not easily break. The leaves of the hinge coupling plates are bendable. Each coupling element has a slot which is integrally connected to a reinforcing strip.

2 Claims, 8 Drawing Sheets

(A)

(B)

STORAGE BOX

BACKGROUND OF THE INVENTION

1. Field of the Invention

The present invention relates generally to a storage box, and more particularly to a storage box with improved hinge coupling plates and fastening means.

2. Description of the Prior Art

In conventional storage boxes, the bottom casing and the top cover are mostly integrally connected. After prolonged use, the connection may easily crack or break. Besides, the top cover and the bottom casing of conventional storage boxes are fastened together by using male and female fastening elements which do not provide good fastening effects.

In another type of storage box, the top cover and the bottom casing are pivotally connected by hinges. The hinges include single bendable leaves. However, the bent portion may crack after prolonged use.

SUMMARY OF THE INVENTION

The present invention relates generally to a storage box, and more particularly to a storage box with improved hinge coupling plates and fastening means.

A primary object of the present invention is to provide a storage box with improved hinge coupling plates, in which the hinge coupling plates are loose-leaf type and are provided to connect a top cover and a bottom casing. The inner sides of the coupling plates are provided with reinforcing strips to ensure that the top cover and the bottom casing are well connected even if the bending points of the hinges are broken.

Another object of the present invention is to provide a storage box with improved fastening means, in which a button seat is a movable type and mounted at a fastener coupling seat at the front side of a bottom casing of the box. The button seat has a projecting that engages a fastening groove at the front side of a top cover of the box. An elastic plate is further provided at that end of the button seat which is to be pushed when trying to open the box. The elastic plate provides a resilience to reset the button seat.

A further object of the present invention is to provide a storage box with movable type hinge coupling plates which can be easily removed for replacement purposes.

The foregoing objects and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numberals refer to identical or similar parts.

Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENT

Figure 1:
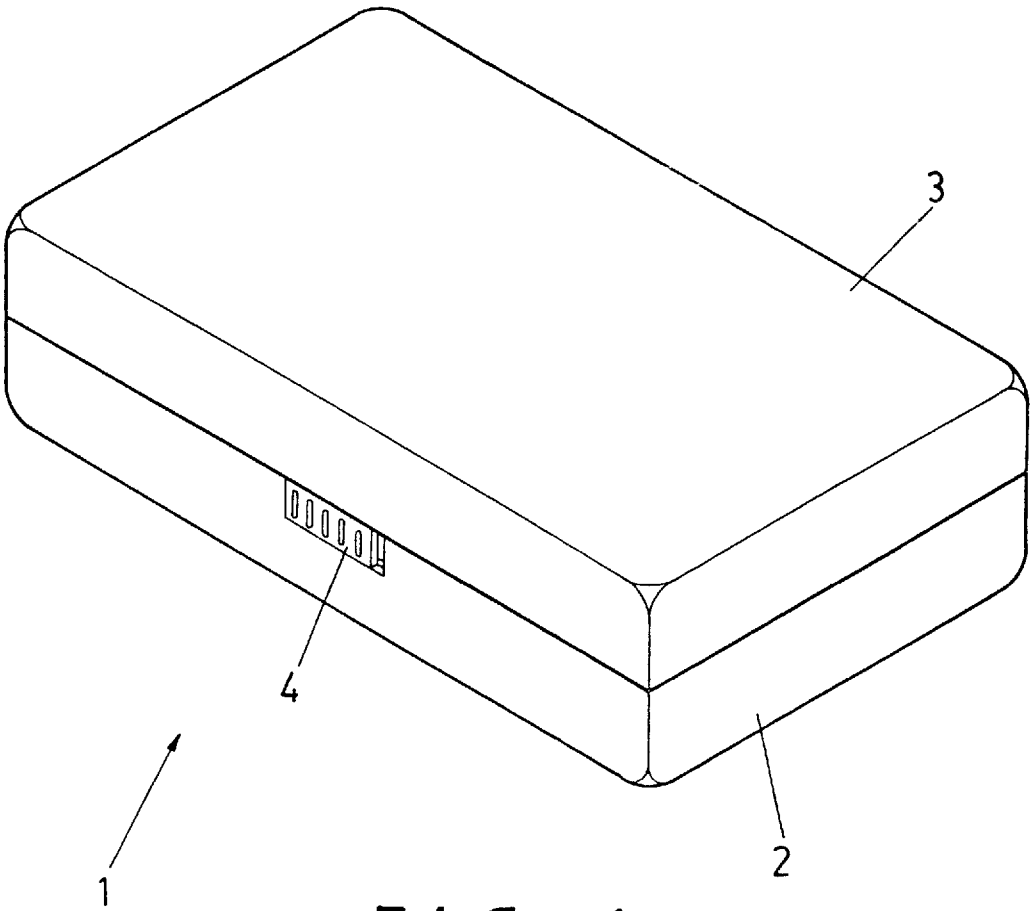
FIG. 1 is a schematic perspective view of the present invention.

For the purpose of promoting an understanding of the principles of the invention, reference will now be made to the embodiment illustrated in the drawings. Specific language will be used to describe same. It will, nevertheless, be understood that no limitation of the scope of the invention is thereby intended, such alterations and further modifications in the illustrated device, and such further applications of the principles of the invention as illustrated herein being contemplated as would normally occur to one skilled in the art to which the invention relates.

Figure 2:
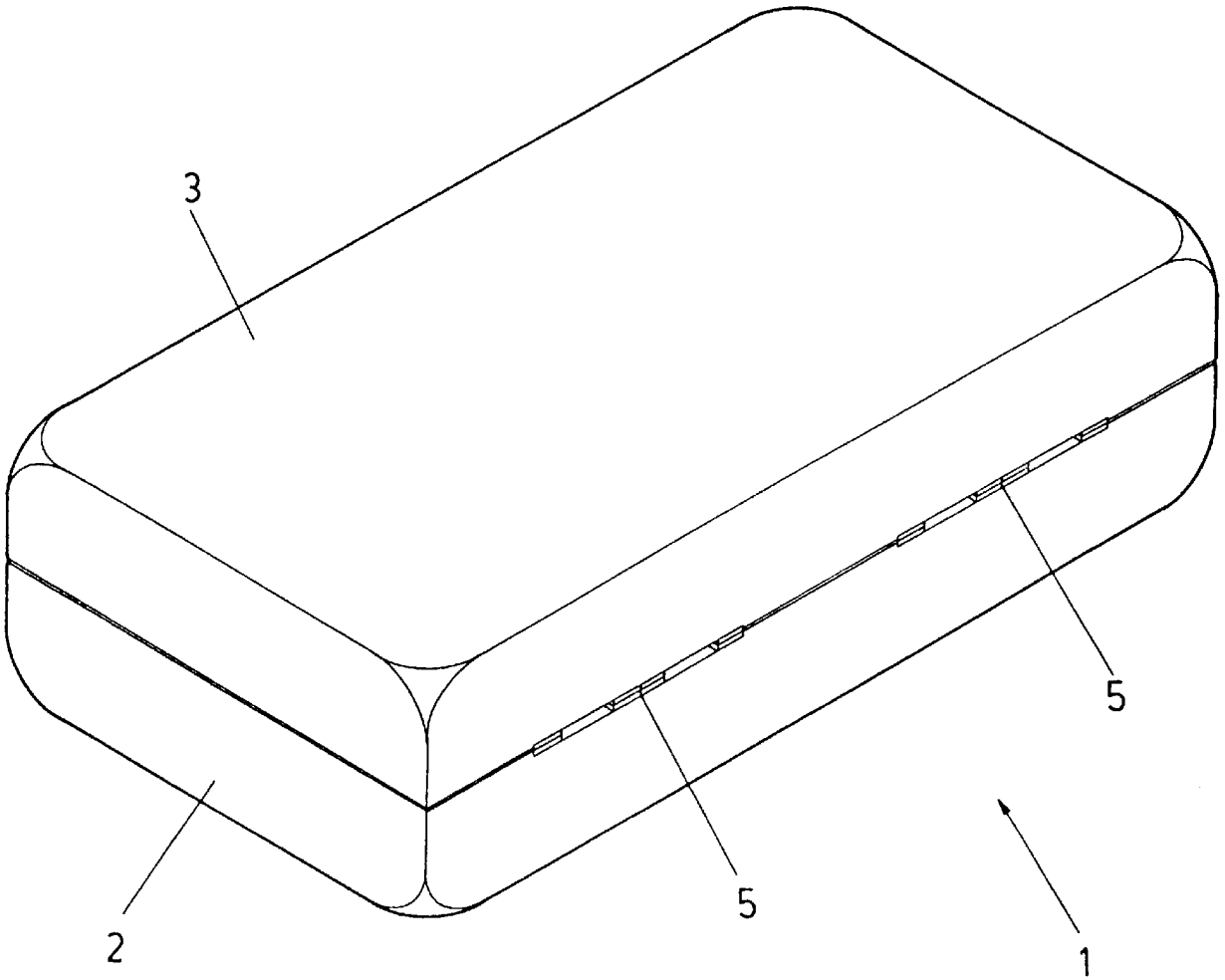
FIG. 2 is a rear view of the present invention.
Figure 3:
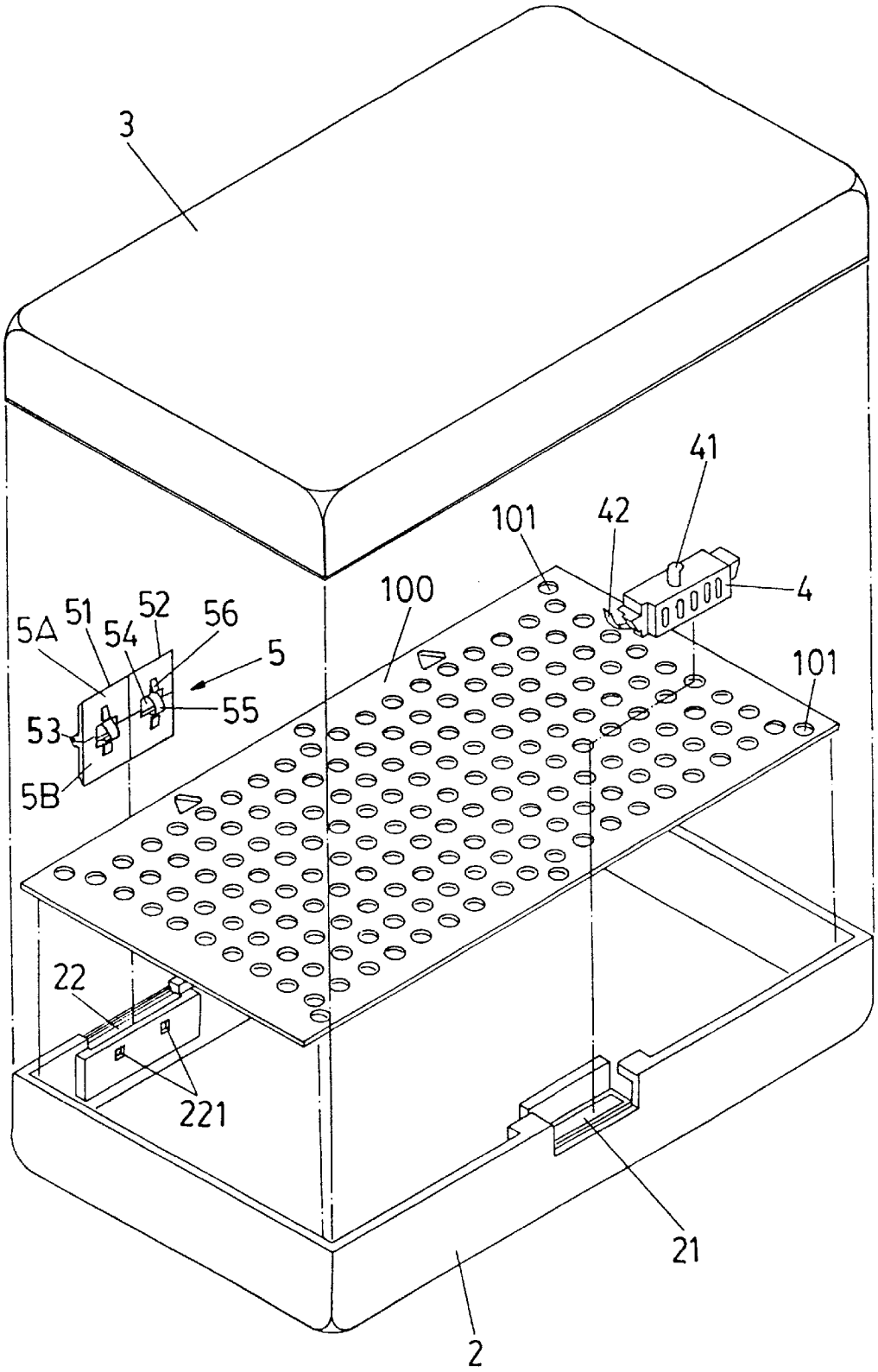
FIG. 3 is a perspective exploded view of the present invention.

With reference to FIGS. 1, 2 and 3, the present invention comprises a box body 1 including a bottom casing 2, a top cover 3, a button seat 4, and at least two pairs of loose-leaf type hinge coupling plates 5.

The bottom casing 2 is an integrally formed rectangular structure having an interior defining a chamber 20. A post 201 is disposed at each of the four corners of the chamber 20 (see FIG. 7). The posts 201 may engage retaining holes 101 corresponding disposed at the four corners of a placement plate 100. At the rear side of the bottom casing 2 is provided the two first hinge coupling seats 22, each of which is provided with two first fastening holes 221. The front side of the bottom casing 2 is provided with a fastener coupling seat 21.

The top cover 3 is likewise an integrally formed rectangular structure of a size matching the bottom casing 2. It also has an interior defining a storage chamber 30. The four corners of the bottom side of the storage chamber 30 are respectively provided with projections 301 (see FIG. 7). These projections 301 may engage the retaining holes 101 at the four corners of the placement plate 100. The rear side of the top cover 3 is provided with two second hinge coupling seats 32 having two second fastening holes 321. The front side of the top cover 3 is provided with a fastening groove 31.

Figure 4A:
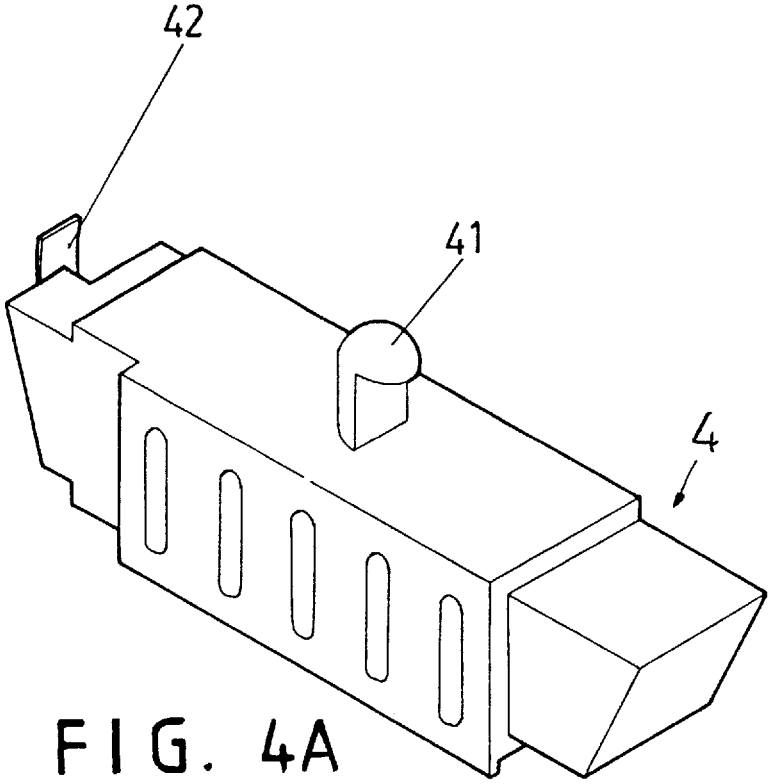
FIGS. 4A and 4B are enlarged perspective views of the front and rear sides of the button seat of the present invention.
Figure 4B:
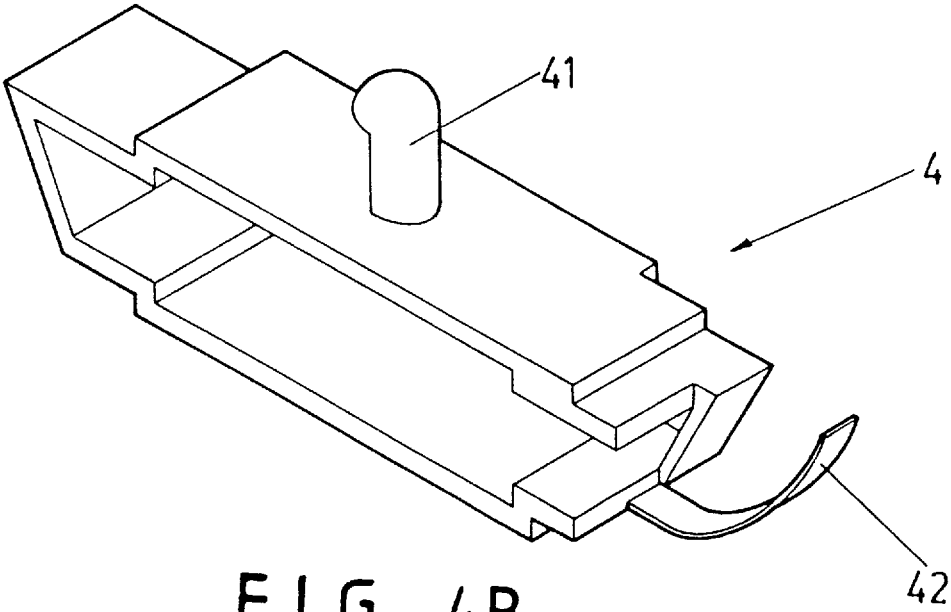

The button seat 4 (see FIGS. 4A and 4B) is mounted at the fastener coupling seat 21 at the front side of the bottom casing 2. The button seat 4 includes a projecting hook 41 for engaging the fastening groove 31. The button seat 4 is further laterally provided with an integrally formed elastic plate 42 for abutting and positioning purposes.

The loose-leaf type hinge coupling plates 59 see FIG. 60 are provided to connect the bottom casing 2 and the top cover 3. They are configured to be bendable elongated plates and are made into two-piece type coupling elements 51, 52, with two contacts at the middle section. The two leaves 5A and 5B are connected by a V shape and are bendable so that they are perpendicular to each other. Four bending points 53 are provided between the leaves 5A and 5B. A slot 54 is disposed at the middle of each coupling element 51 or 52 and the corresponding bending points 53. A reinforcing strip 55 is integrally connected on the slot 54. A multi-piece type elongated hinge structure is thus formed. The leaves 5A and 5B are further provided with four symmetrical bulges 56.

The hinge coupling plates 5 are inserted into the hinge coupling seats 22 and 32 at the rear sides of the bottom casing 2 and the top cover 3 to pivotally connect them together. The button seat 4 is mounted on the fastener coupling seat 21 at the front side of the bottom casing 2 with the projecting hook 41 engaging the fastening groove 31 to allow opening and closing of the box. The reinforcing strips 55 on the hinge coupling plates 5 ensure that the hinges will not easily break to prolong the useful life of the box.

Figure 5A:
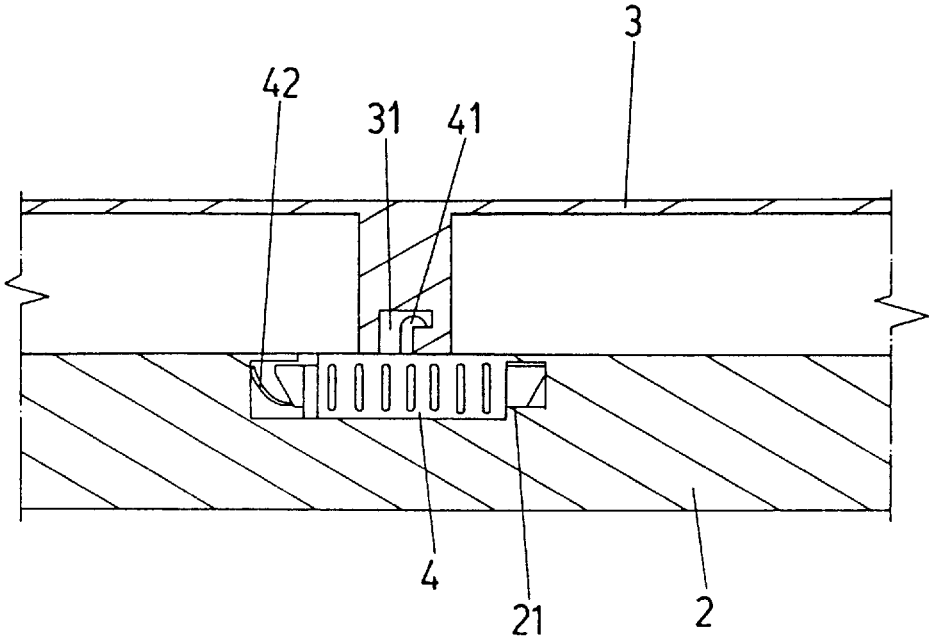
FIGS. 5A and 5B are plan view illustrating operation of the button seat of the present invention.
Figure 5B:
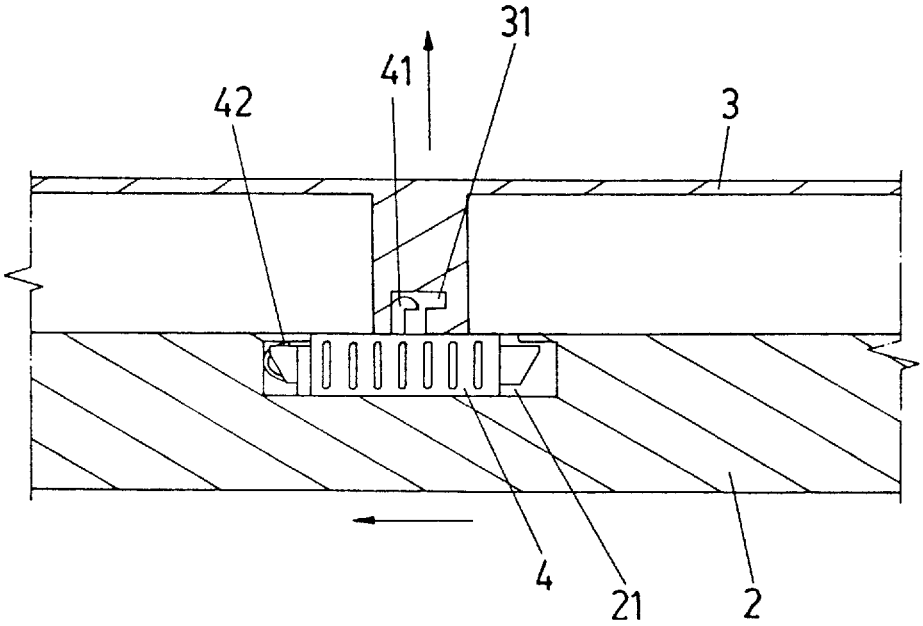
Figure 6A:
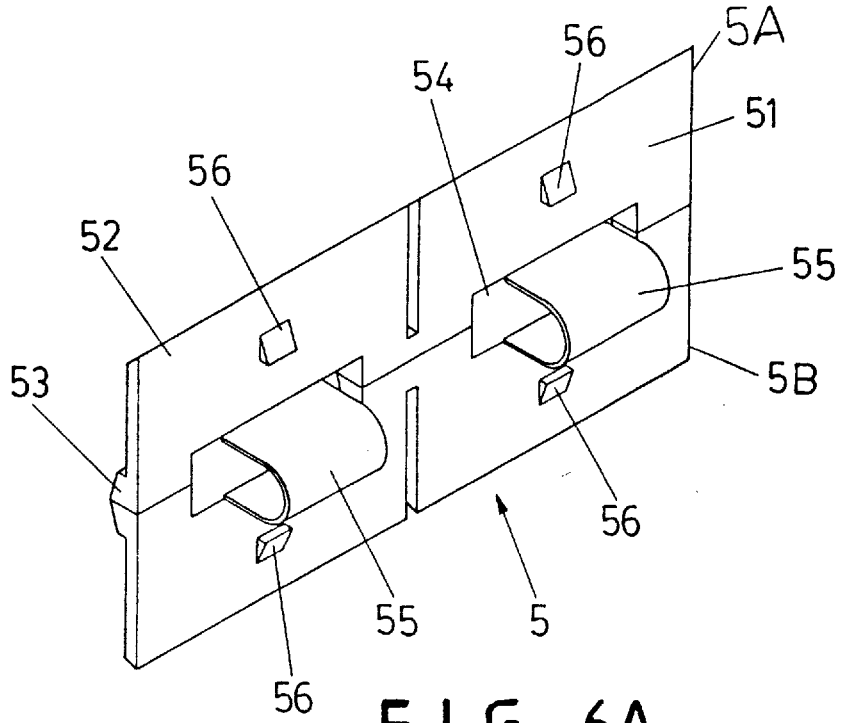
FIGS. 6A and 6B are enlarged perspective views of the front and rear sides of the hinge coupling plates of the present invention.
Figure 6B:
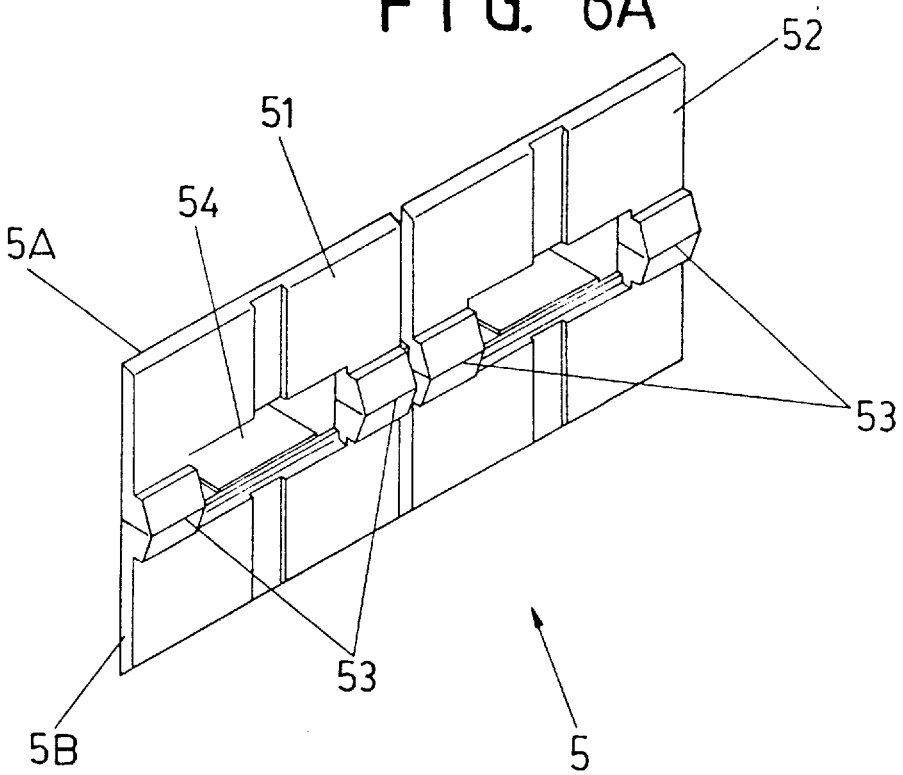

Reference is made to FIGS. 5A and 5B, which illustrate the opening and closing of the button seat 4. As shown in FIG. 5A, the button seat 4 is disposed in the fastener coupling seat 21 at the front end of the bottom casing 2 with the projecting hook 41 engaging the fastening groove 31 of the top cover to close the box body 1. When the button seat 4 is pushed to the left, as shown in FIG. 5B, the elastic plate 42 extending from the left side of the button seat 4 is pressed so that the projecting hook 41 disengages from the fastening groove 41 to allow lifting of the top cover 3. When the button seat 4 is released, it will reset as a result of the elasticity of the elastic plate 42, ensuring that the box body 1 is positively closed.

Figure 7A:
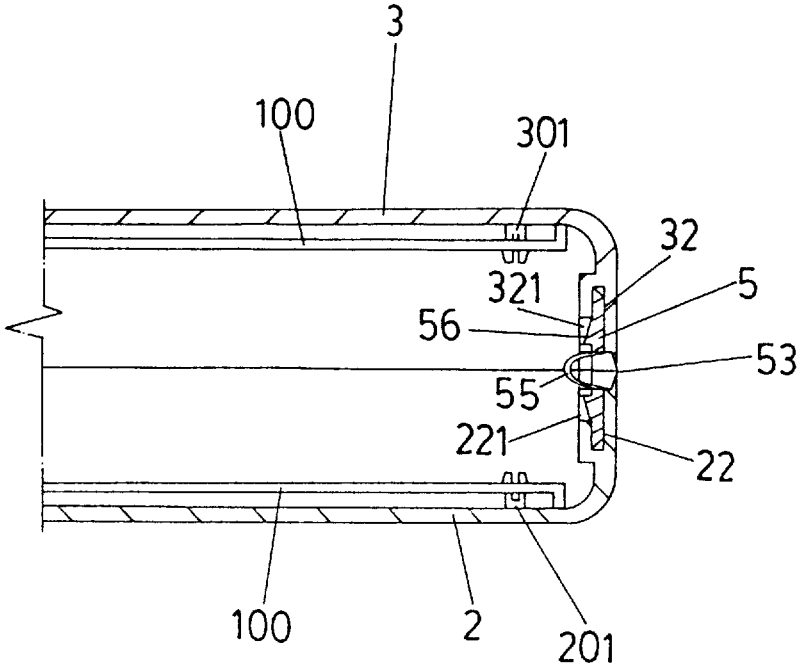
FIGS. 7A and 7B are schematic views illustrating the operation of the hinge coupling plates.
Figure 7B:
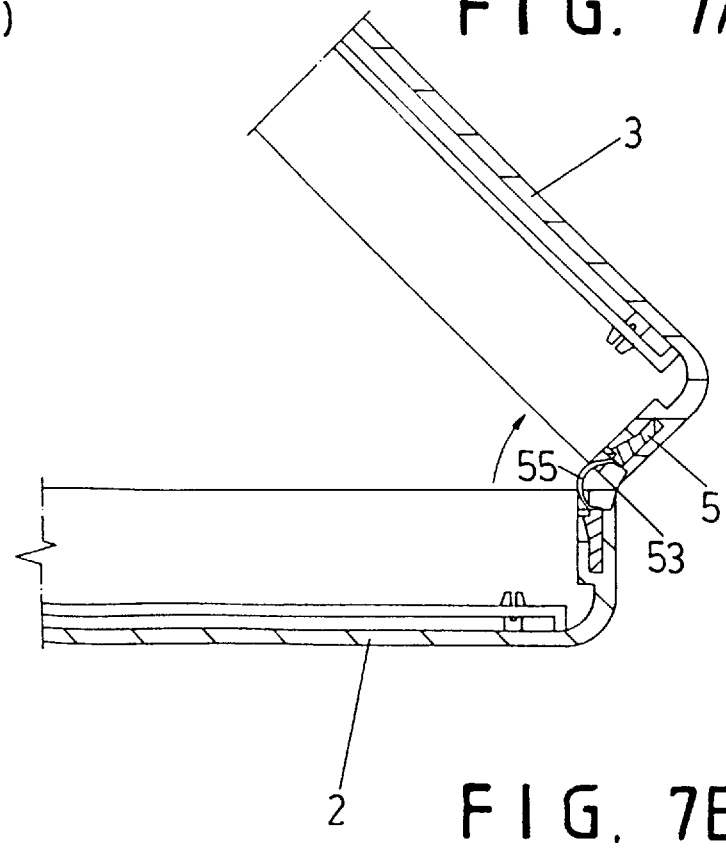

Reference is made to FIGS. 7A and 7B, which illustrate the operation of the hinge coupling plates when the box body 1 is closed or half opened. As shown in FIG. 7A, the box body 1 is closed. The hinge coupling plates 5 are inserted in the hinge coupling seats 22 and 32 on the rear sides of the bottom casing 2 and the top cover 3, with the four bulges 56 engaging the fastening holes 221 and 321 of the hinge coupling seats 22 and 32, thus achieving firm closing of the box body 1. The bending points 53 at the middle of the hinge coupling plates 5 are provided for purposes of connection, while the reinforcing strips 55 are provided to allow closing and opening of the box body 1, as shown in FIG. 7B. If the bending points 53 crack through prolonged use, the reinforcing strips 55 connecting the leaves 5A and 5B will ensure that the boxy body 1 can still be used.

Figure 8:
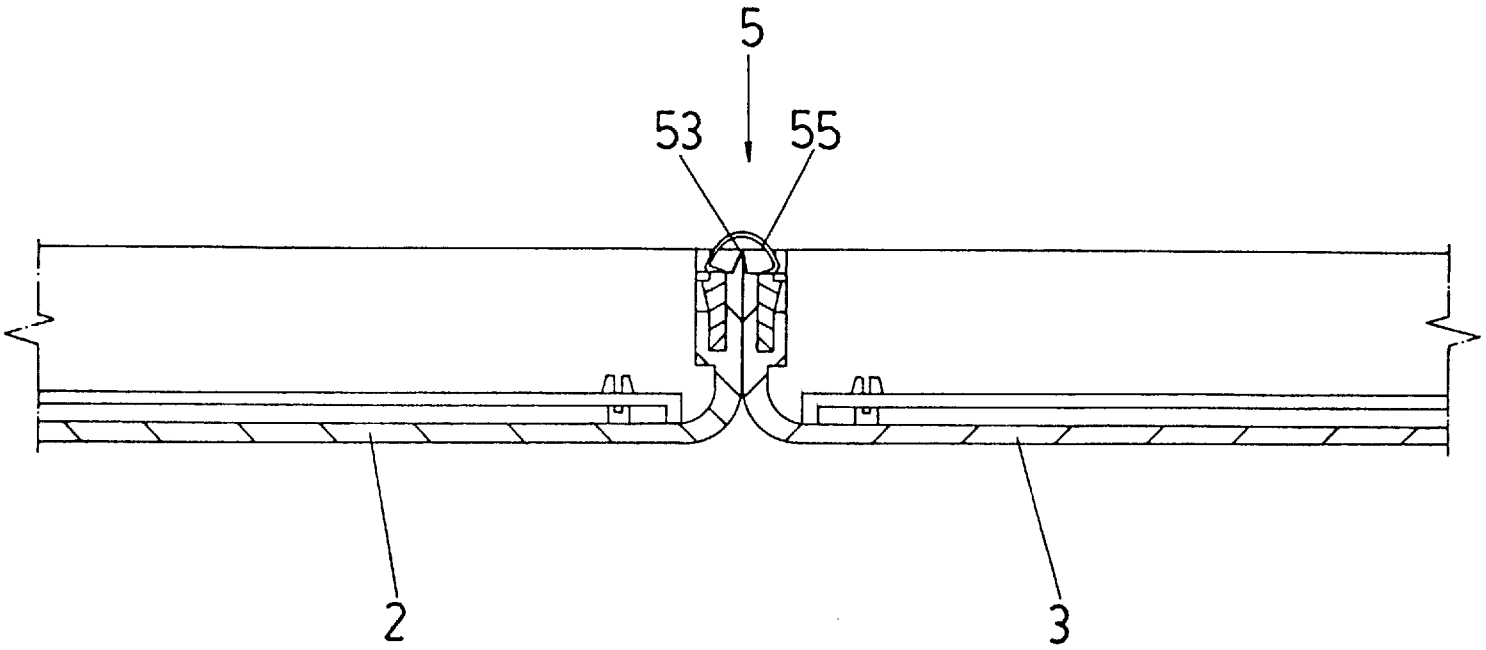
FIG. 8 is a schematic view of the storage box of the present invention in a completely opened state.

Referring to FIG. 8, the hinge coupling plates 5 are bent outwardly through 180 degrees, allowing the top cover 3 and the bottom casing 2 to lie on the same plane in an opened state.

It will be understood that each of the elements described above, or two or more together may also find a useful application in other types of methods differing from the type described above.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

I claim:

1. A storage box, comprising:

a bottom casing which is an integrally formed rectangular structure having an interior defining a receiving chamber, each of the four corners of said receiving chamber being provided with a post, said posts being adapted to engage corresponding retaining holes of a placement plate disposed in said receiving chamber, the rear side of said bottom casing being provided with two first hinge coupling seats each of which has two first fastening holes, and the front side of said bottom casing being provided with a fastener coupling seat;

a top cover which is an integrally formed rectangular structure of a size matching said bottom casing, said top cover having an interior defining a storage chamber, each of the four corners of said storage chamber being provided with a projection, said projections being adapted to engage corresponding retaining holes of a placement plate, the rear side of said top cover being provided with two second hinge coupling seats each of which has two second fastening holes, and the front side of said top cover being provided with a fastening groove;

at least two pairs or loose-leaf type hing ecoupling plates for pivotally connecting said bottom casing and said top cover, said hinge coupling plates being bendable elongated plate structures and made into two-piece type coupling elements having two contacts at the middle sections thereof, said hinge coupling plates each including two leaves which are connected by a V shape and bendable so that they are perpendicular to each other, with four with four bending points therebetween, each coupling element being provided with a slot at said bending points, said slot being integrally connecting to a reinforcing strip, said leaves of each coupling element further having two symmetrical and opposed bulges thereon; and a button seat, mounted at said front side of said bottom casing and provided with a projecting hook for engaging said fastening groove at said front side of said top cover, said button seat being laterally and integrally provided with an elastic plate for abutting and positioning purposes.

2. The storage box as claimed in claim 1, wherein said hinge coupling plates may be configured to be one-piece type or multi-piece type coupling elements depending on the size of said storage box.

* * * * *